US005217674A

United States Patent [19]

Stomp et al.

[11] Patent Number: 5,217,674

[45] Date of Patent: Jun. 8, 1993

[54] DRIVE FOR AUTOMATIC LANCE CHANGING DEVICES

[75] Inventors: Hubert Stomp, Luxembourg; Daniel Fries, Arlon; Serge DeVillet, Buerden, all of Luxembourg

[73] Assignee: Paul Wurth S.A., Luxembourg, Luxembourg

[21] Appl. No.: 843,129

[22] Filed: Feb. 28, 1992

[30] Foreign Application Priority Data

Mar. 1, 1991 [LU] Luxembourg ..... 87-897

[51] Int. Cl.[5] ..... C21C 5/46

[52] U.S. Cl. ..... 266/91; 266/226

[58] Field of Search ..... 266/91, 226

[56] References Cited

U.S. PATENT DOCUMENTS 4,893,791 1/1990 Stomp et al. ..... 266/91

*Primary Examiner*—Melvyn J. Andrews

*Attorney, Agent, or Firm*—Fishman, Dionne & Cantor

[57] ABSTRACT

The invention relates to a drive for an automatic lance-changing device, such as is used in the top-blowing steel-making process. Such a lance-changing device comprises two lance-receiving hooks pivotable about a horizontal axis of rotation, means for the synchronous vertical displacement of these hooks relative to the lance carriage and to the coupling head, means which, during this displacement of the hooks, cause these hooks to execute a pivoting movement about their said axis of rotation, and means for detecting by measurement the load acting on each hook, the latter being a function of the force with which the lance top part is pressed against said coupling head by the hooks. The drive of this invention is a lifting-spindle system, by means of which a vertically displaceable suspension ring for suspension hooks of the lance top part is driven. This lifting-spindle system consists of at least two tie rods, the upper ends of which are equipped with an external movement thread, and of at least two gearwheels, the hubs of which are equipped with a corresponding internal movement thread for interaction with said upper ends. These gearwheels are mounted axially/radially in a gear case which itself rests on load cells. The latter cause the lifting-spindle drive to be switched off automatically when a predetermined pressure force between the lance top part and a coupling head is reached.

4 Claims, 4 Drawing Sheets

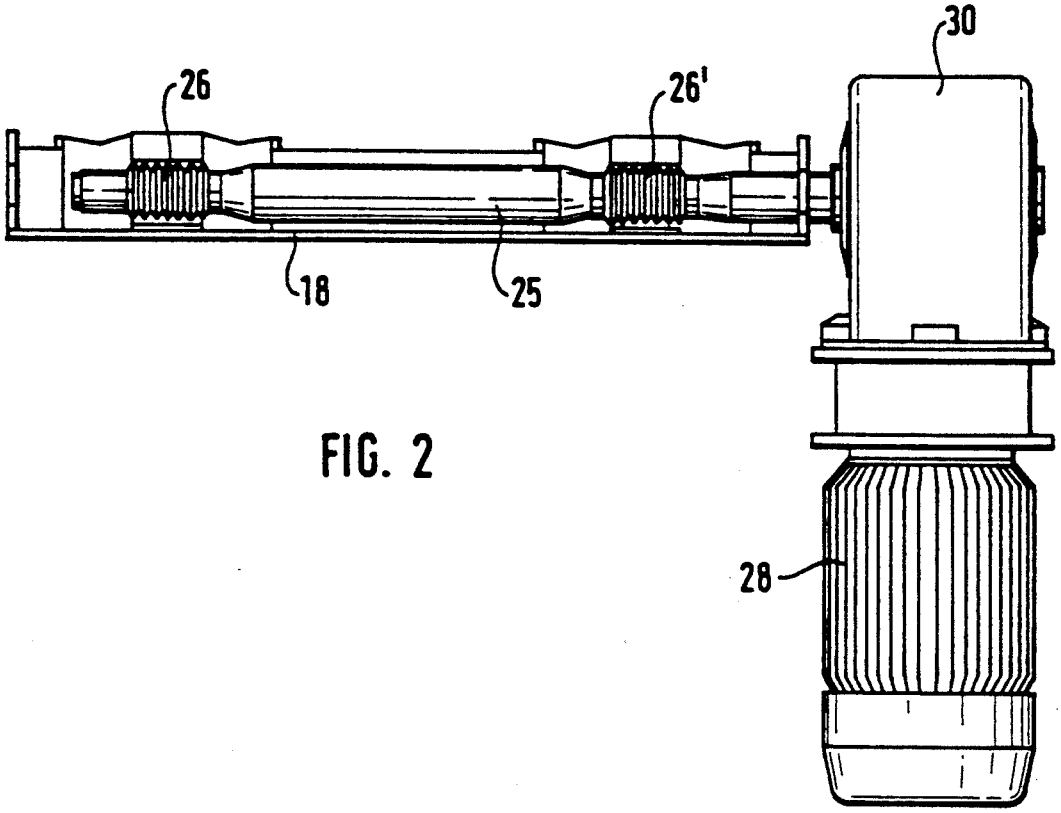
FIG. 2
FIG. 3
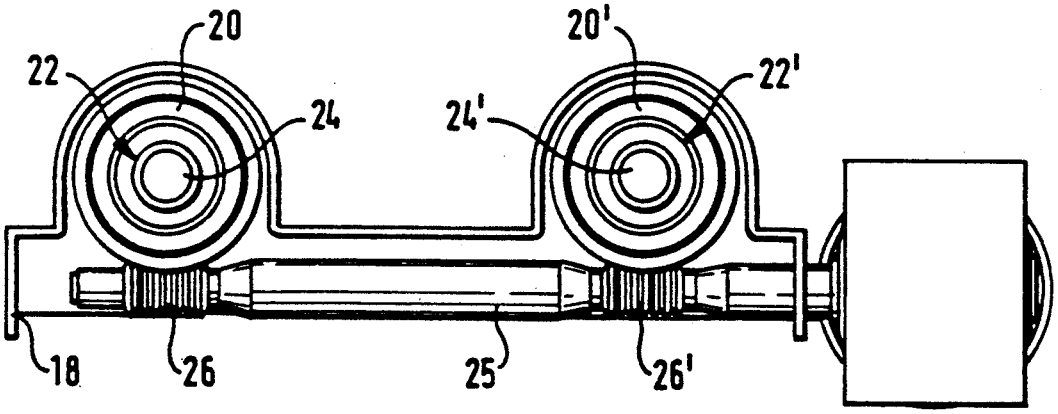

DRIVE FOR AUTOMATIC LANCE CHANGING DEVICES

BACKGROUND OF THE INVENTION

The present invention relates to a drive for automatic lance-changing devices, especially for lances to be coupled and fastened to a vertically movable lance carriage in a top-blowing steel making processes, where the materials required for the blowing, and in some cases also for cooling, are fed to a coupling head on the lance carriage and transferred into the lance top part at the coupling point between the coupling head and said lance top part. Such lance-changing devices have on each of the two sides of the vertical axis of the lance-carriage coupling head a lance-receiving hook pivotable about a horizontal axis of rotation and carried by the lance carriage, means for the synchronous vertical displacement of these hooks relative to the carriage and to the coupling head, means which, during this displacement of the hooks, cause the hooks to pivot about their said axis of rotation, and means for measuring the load acting on each hook, this load being a function of the force with which the lance top part is pressed against said coupling head by the hooks.

An automatic lance-changing device of the above-mentioned type is described in detail in the U.S. Pat. No. 4,893,791, which is incorporated herein by reference. In this prior art lance-changing device, the drive, that is to say the operation of the coupling mechanism for grasping the lance top part and pressing this against said coupling head, is obtained, on the one hand, by means of a drive motor with a following reduction gear and, on the other hand, by means of a separate lifting-spindle system for each of two hooks. Although this automatic lance-changing device works well for its intended purposes, it has various practical disadvantages. Because the two lifting-spindle systems must be loaded synchronously, the reduction gear must have two outputs, and therefore an "off-the-shelf" gear cannot be used for this gear; rather a correspondingly more expensive custom gear must be used.

Furthermore, the separate arrangement of the gear and lifting-spindle system of this prior art device makes its construction both relatively expensive and space-consuming. Finally, the arrangement of the motor and gear in the prior art device is also unfavorable because it restricts the possibilities of the three-dimensional layout of the lines feeding said blowing materials to the coupling head (see, for example, in FIG. 1 of the U.S. Pat. No. 4,893,791, the line 6 which necessarily has to be arranged so as to extend underneath the lance-carriage plate 10).

SUMMARY OF THE INVENTION

To avoid these disadvantages of the present state of the art, the object of the present invention is to provide a drive for automatic lance changing devices in which the system composed of the drive motor, reduction gear, and lifting-spindle mechanism is of ideally compact and inexpensive design. Furthermore, in the present invention a special version of a reduction gear is no longer needed, and appreciably greater freedom is realized for arranging the feed lines to the coupling head.

This object is achieved by means of a drive having a lifting-spindle mechanism, by which a vertically displaceable suspension ring for suspension hooks of the lance top part is driven, this lifting-spindle system consisting of at least two tie rods, the upper ends of which are equipped with an external movement thread, and at least two gearwheels, the hubs of which are equipped with a corresponding internal movement thread for interaction with said tie rod upper ends, said gearwheels being mounted axially/radially in a gear case which itself rests on load cells for automatically switching off the lifting-spindle drive when a predetermined pressure force between the lance top part and a coupling head is reached.

The above-discussed and other features and advantages of the present invention will be appreciated and understood by those skilled in the art from the following detailed description and drawing.

BRIEF DESCRIPTION OF THE DRAWINGS

Referring now to the drawings wherein like elements are numbered alike in the several FIGURES:

FIG. 2 is a front view of the second reduction gear;

FIG. 3 shows a plan view of the reduction gear of FIG. 2;

DESCRIPTION OF THE PREFERRED EMBODIMENT

In the following description, reference is made to a joint consideration of FIGS. 1 to 3.

Figure 1:
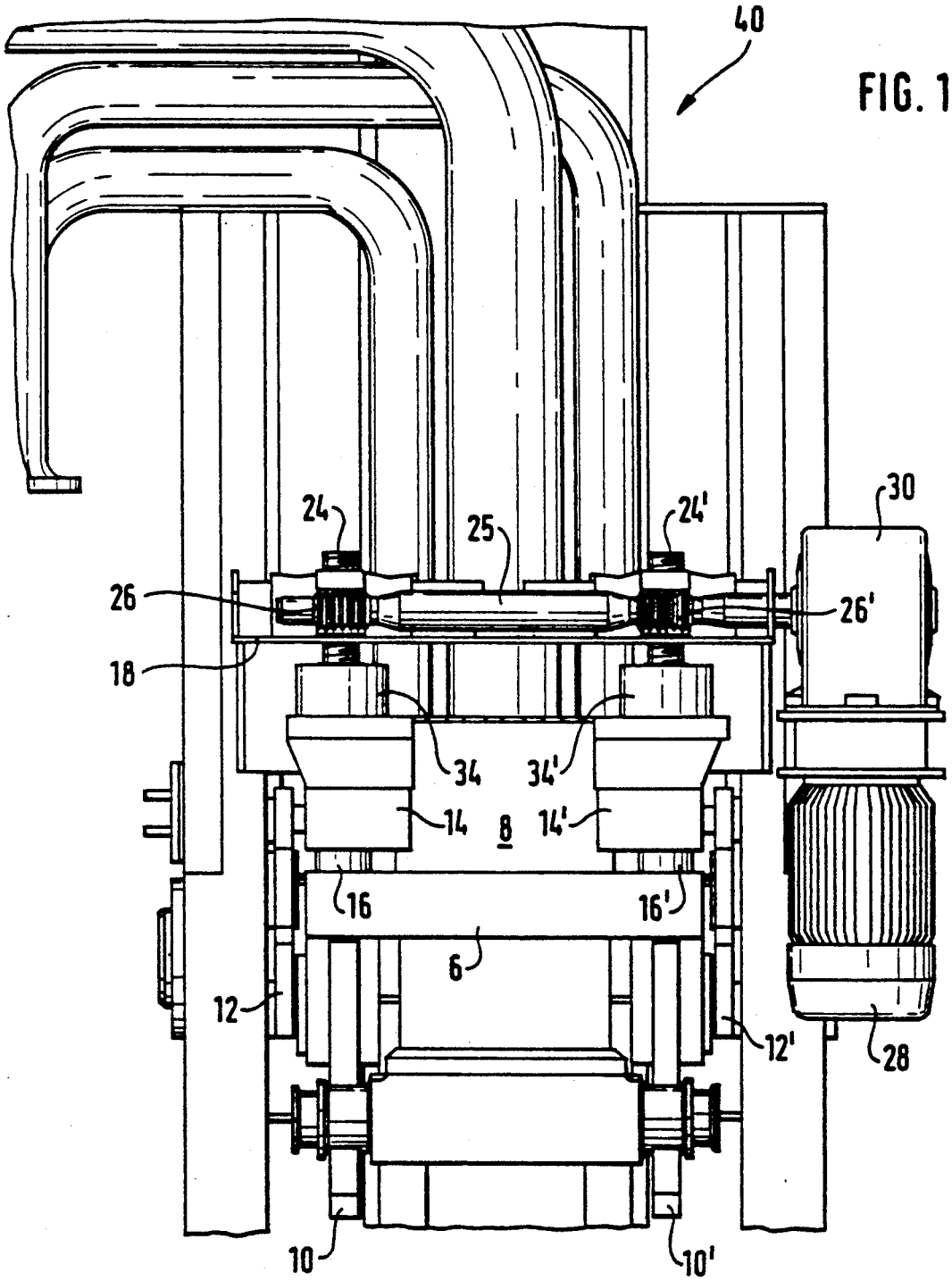
FIG. 1 shows a view of the basic construction of the drive of this invention, having a drive motor, an optional first reduction gear and a second reduction gear according to the invention having an integrated lifting-spindle system.

In FIG. 1 a vertically displaceable supporting ring 6 (corresponding to the supporting ring 36 in the U.S. Pat. No. 4,893,791 document) is guided on a coupling head 8, and lance-receiving hooks 10, 10' (corresponding to the hooks 16, 16' in the document mentioned) are suspended pivotably on ring 6. The pivoting movement is generated, during the displacement of the ring 6, by connecting rods 12, 12' which are pivotably suspended at their upper end on fixed extensions 14, 14' which are unitary with the coupling head 8. For the functioning of this suspension system, reference is made to the U.S. Pat. No. 4,893,791.

In accordance with this invention, the axial displacement of ring 6 takes place, by means of two tie rods 16, 16' which extend into a gear case 18 and which interact there with worm gears 20, 20' (see FIG. 3), these forming parts of a spindle system 22, 22', with an external thread on the upper ends 24, 24' of the tie rods 16, 16' and an internal thread in the bores of the worm gears 20, 20'. The tie rod/worm-gear systems therefore constitute a lifting-spindle system with an effect similar to that of the systems 43 in the U.S. Pat. No. 4,893,791.

The drive of the two worm gears 20, 20', which are mounted with their hubs axially/radially on the case 18, preferably each by means of two tapered roller bearings (not shown), is obtained synchronously by means of a shaft 25, continuous here, or by coupling-connected shafts, on which the worms 26, 26' coupled respectively to the worm gears 20, 20' are arranged.

In FIG. 1, for the sake of illustration, the drive system according to the invention for the automatic lance-changing device is obtained by means of an electric motor 28 with a following angular gear 30. This affords a highly compact drive block ideally adaptable to the particular conditions of space, since the motor 28 can be mounted at an inclination of any angle in relation to the shaft 25. In so far as the conditions of space allow, this electric motor 28 can, of course, also be flanged to the gear case 18 directly or via a so-called spacer piece.

Of course, other drive sources such as hydraulic or pneumatic systems can also be used instead of the electric motor 28 shown for illustration.

Figure 1A:
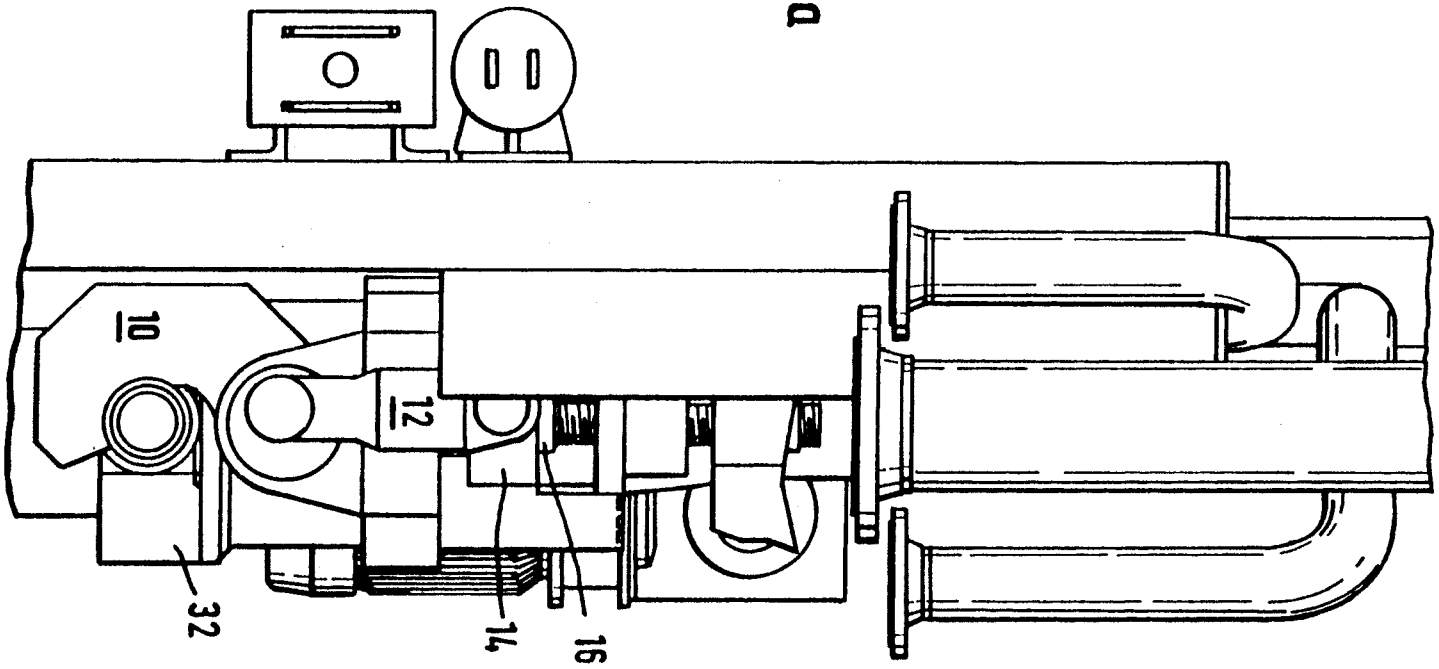
FIG. 1*a* shows a side view from the left of FIG. 1.

The system of the present invention, in a manner similar to that mentioned in U.S. Pat. No. 4,893,791, the lifting-spindle drive is stopped when a predetermined pressure force of the lance top part 32 (see FIG. 1*a*) against the coupling head 8 is reached. For this purpose, the lifting-spindle gear case 18 is supported on two load cells 34, 34' which switch off the drive motor when this pressure force is reached. For a more detailed description of how these load cells function, please see U.S. Pat. No. 4,893,971, columns 3 and 5.

Figure 4:
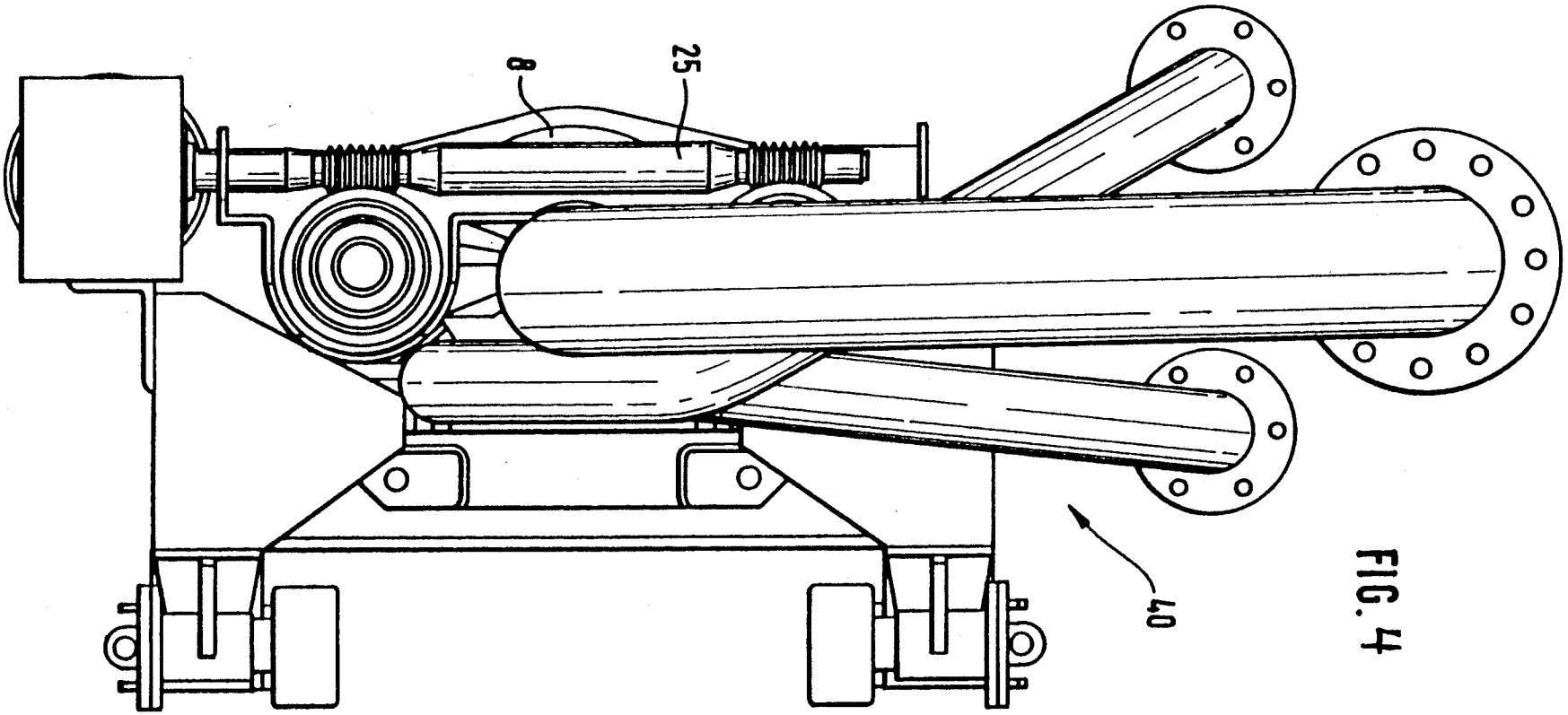
FIG. 4 shows a top view of the drive of FIG. 1.

Finally, the top view according to FIG. 4 illustrates clearly the great extent to which access to the coupling head 8 is now easier in comparison with the version according to U.S. Pat. No. 4,893,791, with a corresponding simplification of the laying of the blowing-material line system 40.

In the foregoing description, the lifting-spindle drive was designed as a worm gear for the sake of illustration. It will, of course, be understood that it is also possible to use any other mechanical drive in which the two lifting spindles are driven synchronously, such as, for example, a chain-wheel drive with the transmission ratio 1:1 between the two spindles.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A drive for automatic lance-changing devices, for lances to be coupled and fastened to a vertically movable lance carriage in steel making by a top-blowing process, the materials required for the blowing being fed to a coupling head on the lance carriage, said lance changing device comprising:

at least two lance-receiving hooks pivotable about a horizontal axis of rotation and coupled to the lance carriage;

means for pivoting said hooks about their said axes of rotation during displacement of said hooks;

means for detecting the load acting on each hook, as a function of the force with which a lance top part is urged against said coupling head by said hooks;

a vertically displaceable supporting ring from which said hooks are suspended, lifting-spindle means for driving said supporting ring, said lifting-spindle means comprising at least two tie-rods each of which has an upper end equipped with an external movement thread, and at least two gears each equipped with a corresponding internal movement thread in a hub thereof for interaction with said upper end of said corresponding tie rod;

means for synchronously driving said lifting-spindle means whereby said hooks are synchronously vertically displaced;

a gear case wherein said gears are axially/radially mounted, said gear case resting on said means for detecting the load acting on each hook for automatically stopping said means for driving said lifting-spindle means when a sufficient pressure force between the lance top part and the coupling head is reached.

2. A drive as in claim 1, wherein said gears are worm gears.

3. A drive as in claim 2, wherein said means for driving said lifting-spindle means comprises:

a common continuous shaft having corresponding worms for synchronously driving said gears.

4. A drive as in claim 1, where said means for driving said lifting-spindle means further comprises:

motor means cooperating with said shaft through a following gear.

* * * * *